United States Patent [19]

Artemov et al.

[11] 3,955,620

[45] May 11, 1976

[54] HEAT EXCHANGER

[76] Inventors: Lev Nikolaevich Artemov, ulitsa Pravdy, 24a; Anatoly Arkadievich Bilyavsky, ulitsa Entusiastov, 12, kv. 1; Stanislav Nikolaevich Vivsik, Bolnichny proezd, 3, kv. 56, all of Podolsk, Moskovskoi oblasti; Nikolai Vasilievich Zozulya, Reiterskaya ulitsa, 30, kv. 6, Kiev; Valery Ivanovich Manaenkov, ulitsa Mira, 8, kv. 10; Viktor Fedorovich Moskvichev, ulitsa Entusiastov, 10, kv. 9, both of Podolsk, Moskovskoi oblast; Evgeny Alexeevich Fadeev, Sevanskaya ulitsa, 7, korpus 1, kv. 64, Moscow, all of U.S.S.R.

[22] Filed: Apr. 26, 1974

[21] Appl. No.: 464,653

[52] U.S. Cl. ..... 165/162; 122/510; 176/78

[51] Int. Cl.[2] ..... F28F 9/00

[58] Field of Search ..... 122/32, 34, 510; 165/162; 176/28

[56] References Cited

UNITED STATES PATENTS

| | | | |
|---|---|---|---|
| 3,104,652 | 9/1963 | Tillequim et al. | 122/32 |
| 3,137,638 | 6/1964 | Kumpf et al. | 122/510 X |
| 3,227,142 | 1/1966 | Bell et al. | 122/34 |
| 3,399,719 | 9/1968 | Forrest et al. | 165/162 X |
| 3,420,297 | 1/1969 | Romanos | 165/162 |
| 3,439,737 | 4/1969 | Boorman et al. | 165/142 X |
| 3,720,259 | 3/1973 | Fritz | 165/162 |

*Primary Examiner*—Charles J. Myhre
*Assistant Examiner*—Theophil W. Streule, Jr.
*Attorney, Agent, or Firm*—Haseltine, Lake & Waters

[57] ABSTRACT

A heat exchanger comprising a number of interchangeable, possibly standardized sections. Each section is made in the form of a bundle of at least partly longitudinally finned tubes, and has strips which serve as spacer elements for fixing the tubes at a certain distance from one another, and bands embracing the tube bundles. The strips have alternating one-sided projections, each projection having the shape of half the perimeter of a rectilineal polygon. Each pair of strips forms cells. The tubes have non-finned portions along the widths of the strips these portions being located at the same level for all the tubes in a section. The cells embrace the non-finned portions of the tubes so that the latter are arranged in parallel rows.

3 Claims, 6 Drawing Figures

HEAT EXCHANGER

The present invention relates to the field of heat and power engineering and more specifically it relates to heat exchangers. This invention can be used to the best advantage in heat exchangers consisting predominantly of sections made of tubes with external longitudinal fins. The heat exchangers of this kind are extensively used in the electric power, chemical, petrochemical, food and other branches of industry for heating or cooling water, steam and various chemical media in a liquid or gaseous state or in the form of a steam-liquid mixture.

Known in the prior art is a water-tube steam generator.

The steam-generating portion of this known device is which has a steam-generating portion that is essentially, a heat-exchanger consisting of heat-exchanging sections in the form of individual tube bundles accommodated in a casing, the open ends of the tubes being secured in tube plates. Each section comprises a bundle of seven tubes, including a central tube and six tubes which are equidistant from the central tube and arranged at identical intervals. The cross section of this tube bundle along the outer contour approaches the shape of a rectilineal hexahedron. All the sections are fixed in a horizontal supporting grating which is located in the casing and is fastened to its wall. The sections are arranged in a staggered order by parallel rows (like the tubes in each bundle) and are offset in each row in one direction relative to one another which ensures the arrangement of all the heat exchanger tubes in a staggered order and in parallel rows. In this known arrangement of the heat-exchanging sections there are gaps between the peripheral tube bundles and the casing wall, these gaps being closed by convex partitions (displacers) of a sheet material, the partitions following a part of the contour of the entire tube bundle and being secured to the perimeter of the casing. The heating or heat carrying medium is supplied to, and discharged from, the chambers of each section through a separate pipe brought out of the casing.

Among the disadvantages of this known device are the following:

complexity of manufacture and assembly of individual sections with the above-described arrangement of tubes in each bundle (due to the necessity of bending the ends of the peripheral tubes in the bundle);

complexity of assembly of the entire block of heating surfaces with the above-described arrangement of each section;

possibility of different deformations of tubes in bundles due to thermal stresses, deviation of their position from that described above, which brings about non-uniform heat exchange, increases the difference of thermal stresses in adjacent tubes thus causing their different deformation which eventually has a naked effect on the reliability and durability of the heat-exchanging sections, all the more so if the tubes are of a considerable length; and necessity for making arrangements for admission and discharge of the heat carrier medium in each section, which complicates the layout of pipelines, hinders repairs and servicing of the heat exchanger.

Also known in the previous art is a vertical steam generator with straight tubes combined into heat-exchanging sections. Each section consists of a bundle of tubes whose open ends are secured in tube plates of inlet and outlet chambers. Located above and below the heat-exchanging sections are one or more inlet and outlet headers connected, respectively, to the inlet and outlet chambers of all the sections or individual groups thereof. The heating medium is supplied into the headers or discharged from them through separate pipes. The inlet and outlet chambers of each section are hexahedral in plan view and, correspondingly, the cross section of each tube bundle is also nearly hexahedral. All the heat-exchanging sections are arranged in parallel rows at the same distance from one another in a staggered order through without being offset in each row. Each heat-exchanging section is provided with at least two bands embracing the entire tube bundle at different levels. The provision of bands in the above-described device limits the possible deformation of tubes within one section and exerts no substantial influence on the service life of the adjacent sections. The provision of headers in the casing simplifies the admission and discharge of the heat carrier and the layouts of the corresponding pipelines.

The disadvantages of this known device are as follows:

irregular arrangement of tubes over the cross section of the heat exchanger which, causes non-uniform heat exchange, different thermal stresses in the tubes of one and the same bundle and their different deformation, leading to the bending of tubes and speeding failures of the heat-exchanging sections;

the open-type bands create additional handicaps in replacing individual sections; and the hexahedral shape (plan view) of the inlet and outlet chambers complicates their manufacture.

Known in the art are spacer elements of heat exchangers in the form of supporting gratings which fix the tubes in preset relative positions at a certain distance from one another.

Such a grating is made up of a certain number of bent strips interconnected in such a manner as to form a multitude of polygonal cells, each cell being limited by two strips and projections. Thus, each cell has at least three projections arranged in such a manner as to support the cylindrical elements of the heat exchanger inside the cell and to retain the parallelism of their axes. At least some of these strips have projections on the opposite edges, the projections being spaced at certain intervals along the strip.

Such gratings fix a group of parallel tubes in preset positions relative to one another. This simplifies the assembly (installation) of the tubular heating surfaces during the manufacture of individual sections even with the bent ends of the tubes, limits the deformation of the tubes in a bundle in case of non-uniform thermal stresses in operation, and does not hinder the flow of the heat carrier in any direction from outside.

Like some other known appliances, this supporting grating is intended for use in heat exchangers with plain cylindrical tubes without longitudinal external fins.

A disadvantage of this grating lies in the complexity of strip manufacture and assembly as well as in the considerable difference both in the length and the shape of the strips from which the grating is made.

Known in the art is a heat exchanger which comprises heat-exchanging sections housed in a casing and communicating with inlet and outlet headers. Each section comprises a bundle of tubes with longitudinal external fins, tube plates and reducing tapered pipe unions at the ends by which the section is secured in the tube plates of the headers, thereby ensuring the required arrangement of sections in the casing and the necessary distance between them.

The tubes are secured at a certain distance from one another in each section by spacer elements in the form of rings slipped on the fins of all the tubes at certain intervals, and all the tubes of an individual section are embraced by bands at several points.

The basic disadvantages of this known heat exchanger are as follows:

necessity for individual installation and fastening of each section in the casing which increases the amount of labour required for the manufacture (assembly) of the heat exchanger and complicates its repairs; and practical impossibility of ensuring an approximately identical cross section of all the sections of other than round or nearly round shape with a preset arrangement of tubes in a section relative to one another, for example in a staggered order. On the one hand, this must be attributed to the fact that the tubes with welded fins are more economical but, as a rule, they differ in their cross sections. This calls for the provision of spacer rings of different sizes so that the distances between the tubes differ too. On the other hand, the use of spacer rings alone fails to ensure the required arrangement of tubes in the section relative to one another so that clamping the groups of tubes by wire bands leads to a relative displacement of the tubes, i.e. their grouping in concentric rows around one or more central tubes in a bundle. Such an arrangement of the tubes denies the possibility of ensuring uniform distribution of the heat carrier over the cross section of the tube bundle and reduces heat-exchange efficiency.

Besides, uniform distribution of the tubes over the entire cross section of the heat exchanger cannot be obtained due to the formation of gaps between the sections. This increases the size of the heat exchanger and impairs its performance.

Another disadvantage of the known heat exchanger lies also in the difficulties encountered in replacing the sections during repairs not only due to the differences in their shape and size but also because the adjacent sections are hooked by bands. Apart from complicating repairs, this may damage the adjacent sections or their fastenings.

The known means for fixing the non-finned tubes relative to one another have not yet proved practicable in the case of the tubes with longitudinal fins.

An object of the present invention resides in simplifying the manufacture and repairs of heat exchangers.

Another object of the present invention is to improve heat exchange within each section.

Still another object of the present invention is to improve heat exchange over the entire cross section of the heat exchanger.

In accordance with these and other objects the present invention consists in providing a heat exchanger comprising interchangeable heat exchanging sections accommodated in a casing, each section being made in the form of a bundle of longitudinally finned tubes with open ends secured in tube plates, having spacer elements for fixing the tubes at certain distances from one another, and bands embracing the tube bundles. According to the invention, the spacer elements are constituted by strips with alternating one-sided projections, each projection being shaped like half the perimeter of a rectilineal polygon, the strips being arranged square to the tube bundle and each pair of strips forming cells. The tubes have non-finned portions along the widths of the strips, these portions being located at the same level for all the tubes of an individual section, the tubes being embraced by these cells so that the tubes are arranged in parallel rows.

Such a structure allows all the tubes of a section to be fixed in the required position relative to one another, at a preset distance between the tubes in each row and between the tube rows, it simplifies the manufacture of the sections, and improves heat exchange within each section.

This also ensures an identical density (distribution) of the tubes across the entire heat exchanger, without gaps, diminishes the cross section of the heat exchanger or increases the heat exchanging surface for the same size of a heat exchanger, and provides for uniform heat exchange conditions throughout the cross section of the heat exchanger.

It is recommended that each band be made in the form of a rigid ring shaped like the perimeter of the rectilineal polygon, some faces of which on the external side surface have at least one projection located opposite one of the adjoining tubes, whereas the other faces on the external side surface are provided with a corrugated sheet by which one band is connected with the corresponding faces of other bands in this section.

All the sections in the casing are preferably arranged in such a manner as to locate the projections on the faces of the bands in one section in the spaces between the corrugations of the sheets on the faces of the adjacent sections. The heights of the projections ensure a distance between the end rows of tubes of the adjacent sections in the casing which distance is equal to that between the rows of tubes that are parallel with them inside the sections.

Such an arrangement of the heat-exchanger sections makes it possible to manufacture them as standardized interchangeable units of the same type-size, with all the tubes in a section arranged in parallel rows, it rules out the formation of gaps between the adjacent sections, and simplifies replacement of the sections during repairs. This ensures uniform distribution of the heat carrier medium across each individual tube bundle and the heat exchanger as a whole which reduces the cross section of the heat exchanger, adds to its compactness, simplifies repairs and servicing. This also renders the heat exchanger with sections of longitudinally finned tubes more competitive and promising in various branches of industry as compared with the known similar designs.

It is recommended that the projections be made on those bands which are nearest to the tube plates. This reduces the amount of labour required for the manufacture of the sections and will facilitate their installation in the casing and replacement during repairs.

Other details and advantages of the invention will now be described by way of example with reference to the accompanying drawings, in which.

Figure 1:
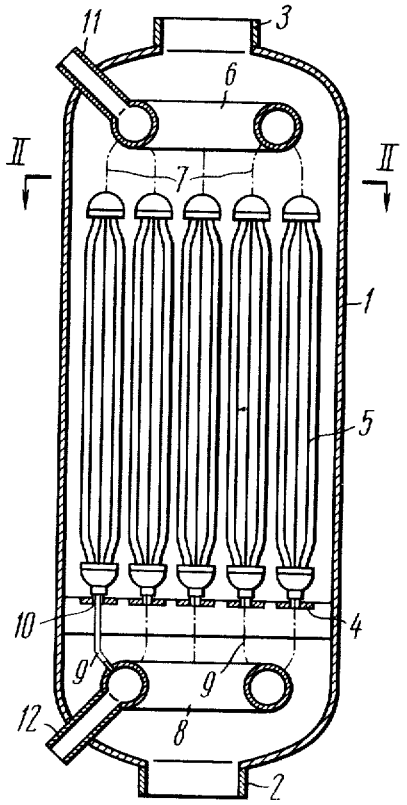
FIG. 1 is a schematic longitudinal section of an exemplary heat exchanger according to the invention.

The inventive heat exchanger comprises a vertical cylindrical casing 1 (FIG. 1) with a pipe connection 2 for admission of a first heat carrier medium and another pipe connection 3 for the discharge of the same medium. Installed in the lower part of the casing 1 is a horizontal supporting or spacer grating 4 on which heat-exchanging sections 5 are vertically mounted.

3. second heat carrier medium is supplied to the heat-exchanging sections 5 from an inlet header 6 through pipes 7 connected to said sections 5. The discharge of the second medium from the heat-exchanging sections 5 is through an outlet header 8 which communicates with said sections 5 through pipes 9 which are similar to the pipes 7 and pass through holes 10 in the horizontal supporting grating 4. The second medium is delivered to the inlet header 6 through a pipe connection 11 and discharged from the outlet header 8 through a pipe connection 12.

Figure 2:
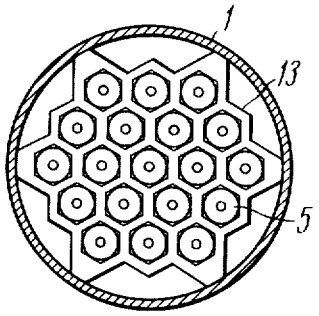
FIG. 2 is a section taken along line II—II in FIG. 1.

Installed between the casing 1 and the peripheral sections 5 are partitions 13 (FIG. 2) made from a sheet material, these partitions being secured to the wall around the perimeter of the casing 1 and extending the whole length of the tubes in the sections 5. The partitions 13 are aimed to improve heat exchange in the intertubular space of the heat exchanger.

The contour of the cross section of all the tube bundles in the heat exchanger approaches the shape of a rectilineal polygon.

Each section 5 (FIG. 3) is a separate unit consisting of a bundle of tubes 14 with longitudinal fins 15 (FIG. 4), the tubes being fastened by their bent open ends 16 in tube plates 17 and 18 which close an inlet chamber 19 and an outlet chamber 20 with dome-shaped housings and pipe connections 21 and 22 for the delivery and discharge, respectively, of the heat carrier. The pipe connection 21 communicates the section 5 through pipe 7 (FIG. 1) with the inlet header 6 whereas the pipe connection 22 (FIG. 3) puts the same section 5 in communication with the outlet header 8 through the pipe 9 (FIG. 1).

Figure 4:
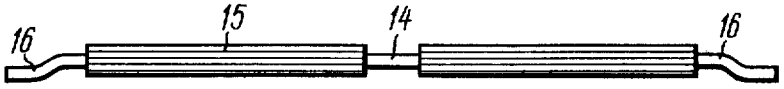
FIG. 4 is a general view of one longitudinally finned tube according to the invention.
Figure 6:
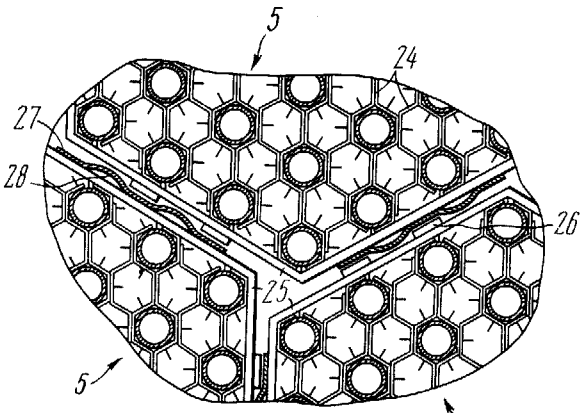
FIG. 6 is a joint between adjacent tube sections according to the invention.
Figure 5:
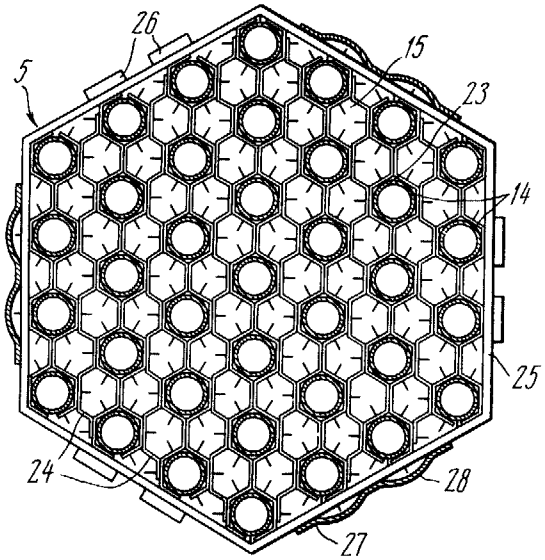
FIG. 5 is a section taken along line V—V in FIG. 3 (enlarged)

All the tubes 14 (FIG. 4) except the central tube have specially bent ends 16 and portions that are free of fins 15. Being of a considerable length, all the tubes 14 can have one or more non-finned portions on the straight parts of the tubes 14, these non-finned portions being located at the same level for all the tubes 14 in the bundle. The non-finned portions of all the tubes 14 are located in cells 23 (FIG. 5) of the supporting or spacer grating 4, preferably made of a set of strips 24 (FIGS. 5, 6) with one-sided projections which, in the longitudinal section of the strip, have the shape of half the perimeter of a rectilineal hexahedron enveloping part of the tube cross section. The projections are spaced along the strip 24 with gaps equal in size to one side of a hexahedron.

All the tubes 14 in a section 5 occupy certain cells of the spacer grating and are located in parallel staggered rows. The cross section of each section 5 over a contour limiting the peripheral tubes 14 is hexahedral though it can be of a different shape, e.g. a triangle or a parallelogram.

Figure 3:
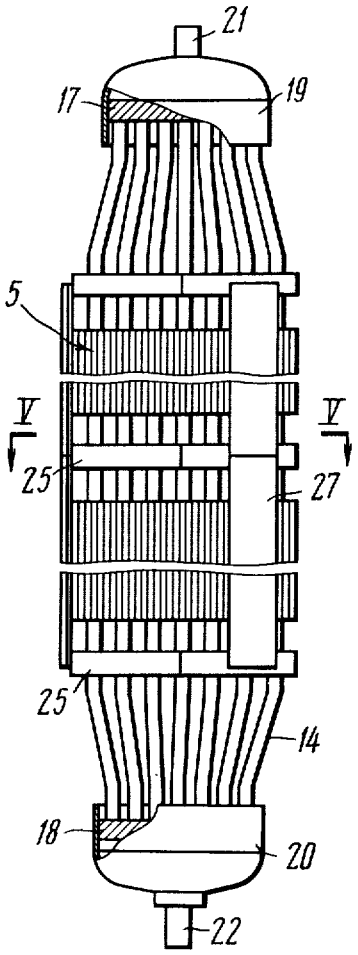
FIG. 3 is a general view of an individual heat-exchanger section according to the invention.

The spacer grating is formed during the assembly of the section 5 by successive installation of strips 24 and tubes 14. The strips 24 can be interconnected during assembly by, say, welding at several points though it is not of particular importance. Each spacer grating is embraced on the outside by a band 25 made either of a single strip or of individual elements thereof. The majority of the strips 24 are connected to the band 25 at least by their ends. This design of the supporting grating allows any tube 14 to be turned about its axis which renders it possible first to assemble a tube bundle and later to install the tube plates 17, 18 (FIG. 3). This simplifies the manufacture of the heat-exchanging sections 5. Some faces of the external side surface of the bands 25 occupying extreme positions in the section 5 are provided with projections 26 (FIG. 3) in the form of ribs which extend along the band face opposite one of the tubes 14. One face of the band 25 may be provided with one or two projections 26 (a larger number being unnecessary). The other corresponding faces of the external side surface of all the bands 25 in a section 5 are connected by separate sheets 27 provided with corrugations 28, the distance between the crests of these corrugations being equal to the distance between any two tubes 14 in a row, these corrugations closing the ends of tube fins 15 which extend beyond the band 25. Every sheet 27 should have not less than two corrugations 28.

All the sections 5 fit snugly into the casing 1 (FIG. 6), at least one projection 26 on the faces of the bands 25 of one section 5 fitting freely between the corrugations 28 of the sheets 27 on the adjoining faces of the adjacent sections 5. This condition determines the width of the projection 26 which is preferably smaller than the distance between the two adjacent corrugations 28. The height of the projection 26 ensures a distance between the parallel end rows of the tubes 14 of the adjacent sections that is equal to the distance between the rows of the tubes 14 which are parallel to them inside the section 5.

In the heat exchanger described above the projections 26 on a part of the faces of the side surface of the bands 25 in all the sections 5 are of the same height expressed as $$h = \text{the } R + \delta_1 - 2\,\delta_2 - \delta_3$$

where:

$h$ = the height of the projection 26

$R$ = the outside radius of the tubes 14 $\delta_1$ = the thickness of the strips 24

$\delta_2$ = the thickness of the wall of the band 25

$\delta_3$ = the thickness of corrugated sheet 27.

It follows from the above equation that:

1. With $h = 0$ the projections 26 on some faces of the bands 25 are unnecessary as are unnecessary the corrugations 28 on the sheets 27 connecting other corresponding faces of the bands, i.e. this sheet 27 must be smooth.

2. With $h < 0$, even without the projections 26 and corrugations 28 on the sheets 27, the passages between the adjacent sections 5 will be larger than those between the tubes 14 inside the sections 5 which is highly undesirable due to a sharp reduction of heat exchange.

3. The height of the fins 15 on the tubes 14 should be smaller than half the difference of the distance between the tubes 14 in a row and the outside diameter of the tube 14 otherwise the assembly of individual sections 5 or installation of the sections 5 in the casing 1 may prove impossible.

Such an arrangement of the sections ensures staggered parallel rows with a successive perpendicular displacement of each section 5 in a row by half the tube pitch in each section 5. In this case the tubes 14 of all the sections 5 in the heat exchanger form a single bundle wherein all the tubes 14 are arranged in staggered parallel rows, which equalizes the heat exchange of the medium over the entire cross section and the thermal deformation of the entire bundle of the tubes 14, and promotes the durability and reliability of the heat exchanger. Simultaneously, it facilitates installation of the sections 5 during the heat exchanger assembly and replacement of any section 5 during repairs.

The heat exchanger according to the invention functions as follows.

The second heat carrier medium flows through the pipe connection 11 into the inlet header 6 from where it passes through the pipes 7 into the inlet chambers 19 (FIG. 3) of the heat-exchanging sections 5, moves through the tubes 14, gives away its heat and enters the outlet chamber 20 from which it flows through the pipe connections 22 and pipes 9 (FIG. 11) into the outlet header 8 and is discharged from the heat exchanger through the pipe connection 12 of the header 8. The 1st heat carrier medium enters the casing 1 through the pipe connection 2, washes the header 8 and the pipes 9 on the outside and passes further into the casing 1 towards the sections 5 through the gaps between the domeshaped housings of the sections 5; here it washes the finned tubes 14 of all the sections 5 on the outside, abstracting heat from them; then it washes the pipes 7 and header 6, and leaves the casing 1 through the pipe connection 3.

We claim:

1. A heat exchanger comprising a casing; interchangeable heat-exchanging sections accommodated in said casing, and including main heat-exchanger means and auxiliary heat-exchanger means associated therewith; at least partly longitudinally finned tubes in said sections, having open ends and forming at least two bundles; said tubes having non-finned portions located at the same level for all tubes in each of said sections; tube plates for securing said open ends of the tubes with freedom of at least partial rotation; strips with alternating one-sided projections, each of the latter being shaped as half the perimeter of a rectilineal polygon, said strips serving as spacer elements for fixing said tubes at predetermined distances from one another, and arranged perpendicular to said bundles of the tubes; the widths of said strips being approximately equal to those of said non-finned portions of the tubes, formed by pairs of said strips and being fitted around said non-finned portions; said main heat-exchanger means being uniformly distributed over the entire cross-section of the heat exchanger and being essentially constituted by said tubes in the at least two bundles, said tube plates and said strips; wherein said auxiliary heat-exchanger means includes bands embracing said bundles of the tubes and having projections on some of their external surfaces; and corrugated sheets along at least others of said external surfaces, for cooperation with said spacer elements; said main and said auxiliary heat-exchanger means providing for improved and uniform heat-exchange conditions throughout the entire cross-section of the heat exchanger.

2. The heat exchanger as defined in claim 1, wherein said bands are made in the form of rigid rings shaped as the perimeter of the rectilineal polygon, which rings have said projections thereon, the latter being located opposite respective ones of the adjoining tubes; the polygon being provided with said corrugated sheets on others of said external surfaces, by which one of said bands is connected to corresponding faces of other bands in the same heat-exchanging section, said corrugated sheets of one of said bundles of the tubes being juxtaposed to said projections of others of said bundles, and vice versa; said sections being disposed within said casing so that said projections of any particular section are accommodated in spaces between the corrugations of said sheets of adjacent sections; the heights of said projections ensuring the distances between the end rows of said tubes of said adjacent sections in the casing, which distances are equal to those between rows of said tubes that are parallel with them in said sections.

3. The heat exchanger as defined in claim 2, wherein said projections are provided on said external surfaces of those bands that are nearest to said tube plates.

* * * * *